US009207583B1

(12) United States Patent
Shimizu et al.

(10) Patent No.: US 9,207,583 B1
(45) Date of Patent: Dec. 8, 2015

(54) DEVELOPING DEVICE AND IMAGE FORMING APPARATUS PROVIDED WITH SAME

(71) Applicant: KYOCERA Document Solutions Inc., Osaka-shi, Osaka (JP)

(72) Inventors: Tamotsu Shimizu, Osaka (JP); Masaru Hatano, Osaka (JP); Asami Sasaki, Osaka (JP); Norio Kubo, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/823,200

(22) Filed: Aug. 11, 2015

(30) Foreign Application Priority Data

Aug. 18, 2014 (JP) ..... 2014-165840

(51) Int. Cl.
*G03G 15/09* (2006.01)
*G03G 15/08* (2006.01)

(52) U.S. Cl.
CPC ..... *G03G 15/0928* (2013.01); *G03G 15/0812* (2013.01)

(58) Field of Classification Search
CPC ..... G03G 15/0982; G03G 15/0812
See application file for complete search history.

(56) References Cited

U.S. PATENT DOCUMENTS

2009/0311012 A1 12/2009 Mabuchi et al.
2010/0080611 A1* 4/2010 Kurachi ..... G03G 15/0818 399/111
2012/0213549 A1* 8/2012 Mori ..... G03G 15/751 399/111

FOREIGN PATENT DOCUMENTS

JP 2009-300677 12/2009

* cited by examiner

*Primary Examiner* — David Gray
*Assistant Examiner* — Michael Harrison
(74) *Attorney, Agent, or Firm* — Gerald E. Hespos; Michael J. Porco; Matthew T. Hespos

(57) ABSTRACT

A developing device includes a housing, a developer carrier, a conveying member and a surface layer. The developer carrier carries a developer on a circumferential surface. The conveying member is rotatably arranged in a first conveying portion and conveys the developer in the first conveying direction and supplies the developer to the developer carrier. The surface layer is formed on a surface of a predetermined cylindrical base member. The surface layer is formed by an immersion method of immersing the base member in a predetermined immersion tank so that an axial direction of the base member extends along a vertical direction. A lower end side of the base member at the time of the immersion is arranged in an upstream side of the housing and an upper end side of the base member at the time of the immersion is arranged in a downstream side of the housing.

10 Claims, 8 Drawing Sheets

DEVELOPING DEVICE AND IMAGE FORMING APPARATUS PROVIDED WITH SAME

INCORPORATION BY REFERENCE

This application is based on Japanese Patent Application No. 2014-165840 filed with the Japan Patent Office on Aug. 18, 2014, the contents of which are hereby incorporated by reference.

BACKGROUND

The present disclosure relates to a developing device and an image forming apparatus provided with the same.

In an electrophotographic image forming apparatus such as a copier, a printer or a facsimile machine, a toner image is formed on an image carrier (e.g. photoconductive drum or transfer belt) by supplying toner to an electrostatic latent image formed on the image carrier and developing the electrostatic latent image. A touch-down development method using a developer containing nonmagnetic toner and magnetic carrier, a magnetic one-component development method and the like are known as methods for development. In the touch-down development method, a two-component developer layer (so-called magnetic brush layer) is carried on a magnetic roller, toner is moved onto a developing roller from the two-component developer layer and a toner layer is carried on the developing roller. Conventionally, a technology for providing a resin layer on a surface of the developing roller arranged to face a photoconductive drum is known. Further, there is known an immersion method (dip method, dipping method) of manufacturing a developing roller by immersing a stock tube of the developing roller in a resin liquid in which a resin material is dissolved in advance.

SUMMARY

A developing device according to one aspect of the present disclosure includes a housing, a developer carrier, a developer container, a conveying member and a surface layer. The developer carrier is formed into a cylindrical shape and supported in the housing rotatably about an axis and carries a developer on a circumferential surface. The developer container is arranged to face the developer carrier. The developer container includes a first conveying portion in which the developer is conveyed in a first conveying direction from one end side toward the other end side in an axial direction of the developer carrier, and a second conveying portion which communicates with the first conveying portion at opposite end parts in the axial direction and in which the developer is conveyed in a second conveying direction opposite to the first conveying direction. The conveying member is rotatably arranged in the first conveying portion and conveys the developer in the first conveying direction and supplies the developer to the developer carrier. The surface layer is arranged on or arranged to face the circumferential surface of the developer carrier and formed on a surface of a predetermined cylindrical base member. The surface layer is formed by an immersion method of immersing the base member in a predetermined immersion tank so that an axial direction of the base member extends along a vertical direction. A lower end side of the base member at the time of the immersion is arranged in an upstream side of the housing in the first conveying direction and an upper end side of the base member at the time of the immersion is arranged in a downstream side of the housing in the first conveying direction.

An image forming apparatus according to another aspect of the present disclosure includes the above developing device and an image carrier. An electrostatic latent image is formed on a surface of the image carrier and the developer is supplied to the image carrier from the developing device.

DETAILED DESCRIPTION

Hereinafter, an embodiment of the present disclosure is described with reference to the drawings. Note that the present disclosure can be applied to an electrophotographic image forming apparatus such as a copier, a printer, a facsimile machine or a complex machine provided with these functions.

Figure 1:
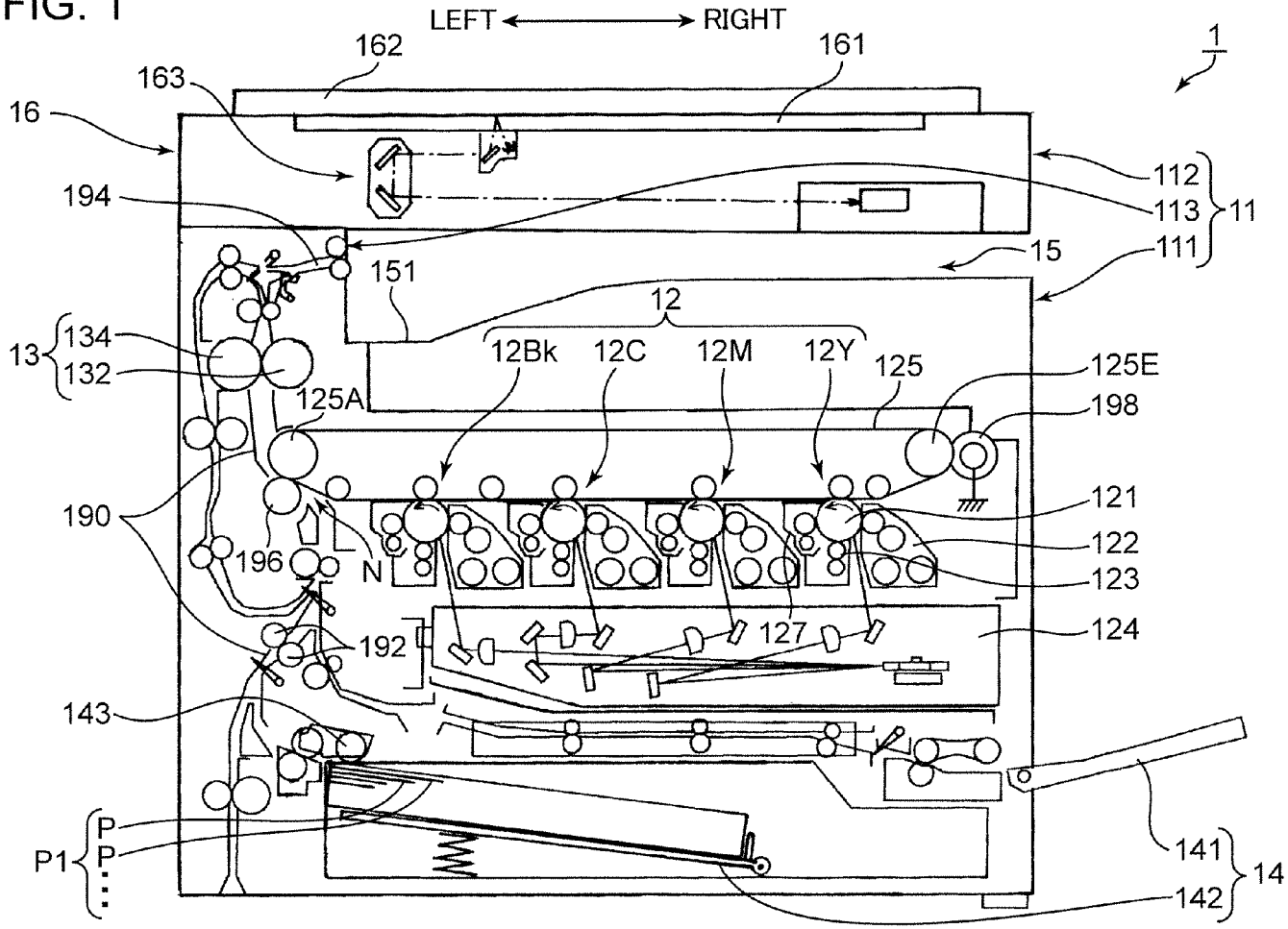
FIG. 1 is a sectional view showing the internal structure of an image forming apparatus according to an embodiment of the present disclosure.

FIG. 1 is a sectional front view showing the structure of an image forming apparatus 1 according to one embodiment of the present disclosure. The image forming apparatus 1 is so configured that an image forming station 12, a fixing device 13, a sheet feeding unit 14, a sheet discharging unit 15, a document reading unit 16 and the like are provided in an apparatus main body 11.

The apparatus main body 11 includes a lower main body 111, an upper main body 112 arranged to face this lower main body 111 from above and a coupling portion 113 interposed between these upper and lower main bodies 112, 111. The coupling portion 113 is a structure for coupling the lower and upper main bodies 111, 112 to each other in a state where the sheet discharging unit 15 is formed between the both, stands from left and rear parts of the lower main body 111 and is L-shaped in a plan view. The upper main body 112 is supported on an upper end part of the coupling portion 113.

The image forming station 12, the fixing device 13 and the sheet feeding unit 14 are housed in the lower main body 111 and the document reading unit 16 is mounted in the upper main body 112.

The image forming station 12 performs an image forming operation of forming a toner image on a sheet P fed from the sheet feeding unit 14. The image forming station 12 includes a yellow unit 12Y, a magenta unit 12M, a cyan unit 12C and a black unit 12Bk respectively using toner of yellow, magenta, cyan and black colors and successively arranged from an upstream side toward a downstream side in a horizontal direction, an intermediate transfer belt 125 stretched on a plurality of rollers such as a drive roller 125A in such a manner as to be able to endlessly travel in a sub scanning direction in image formation, a secondary transfer roller 196 held in contact with the outer peripheral surface of the intermediate transfer belt 125, and a belt cleaning device 198.

The unit of each color of the image forming station 12 integrally includes a photoconductive drum 121 (image carrier), a developing device 122 for supplying the toner (developer) to the photoconductive drum 121, a toner cartridge (not shown) containing the toner, a charging device 123 and a drum cleaning device 127. Further, an exposure device 124 for exposing each photoconductive drum 121 to light is horizontally arranged below the adjacent developing devices 122.

The photoconductive drum 121 is formed into a cylindrical shape and rotated about an axis. The photoconductive drum 121 has an electrostatic latent image formed on the circumferential surface thereof and carries a toner image obtained by developing the electrostatic latent image with the toner. In this embodiment, the photoconductive drum 121 is a known amorphous silicon (a-Si) photoconductor.

The developing device 122 supplies the toner to an electrostatic latent image on the circumferential surface of the photoconductive drum 121 rotating in a direction of an arrow to form a layer of the toner, and forms a toner image corresponding to image data on the circumferential surface of the photoconductive drum 121. The toner is appropriately supplied to each developing device 122 from the toner cartridge.

Each charging device 123 is provided at a position right below the corresponding photoconductive drum 121. The charging device 123 uniformly charges the circumferential surface of each photoconductive drum 121.

The exposure device 124 is provided at a position below the respective charging devices 123. The exposure device 124 irradiates the charged circumferential surface of the photoconductive drum 121 with laser light corresponding to each color based on image data input from a computer or the like or image data obtained by the document reading unit 16, thereby forming an electrostatic latent image on the circumferential surface of each photoconductive drum 121. Note that the exposure device 124 irradiates the laser light according to an exposure light amount set in advance in order to form a predetermined latent image potential on the photoconductive drum 121. The drum cleaning device 127 is provided to the left of each photoconductive drum 121 and cleans the circumferential surface of the photoconductive drum 121 by removing the residual toner.

The intermediate transfer belt 125 is an endless, electrically conductive and soft belt having a laminated structure composed of a base layer, an elastic layer and a coating layer. The intermediate transfer belt 125 is mounted on a plurality of tension rollers arranged substantially in the horizontal direction above the image forming station 12. The tension rollers include the drive roller 125A arranged near the fixing device 13 to rotationally drive the intermediate transfer belt 125 and a driven roller 125E arranged at a predetermined distance from the drive roller 125A in the horizontal direction and configured to rotate, following the rotation of the intermediate transfer belt 125. The intermediate transfer belt 125 is driven to rotate in a clockwise direction in FIG. 1 by giving a rotational drive force to the drive roller 125A.

A secondary transfer bias applying unit (not shown) is electrically connected to the secondary transfer roller 196. A toner image formed on the intermediate transfer belt 125 is transferred to a sheet P conveyed from a pair of conveyor rollers 192 located below by a transfer bias applied between the secondary transfer roller 196 and the drive roller 125A. The belt cleaning device 198 is arranged to face the driven roller 125E via the intermediate transfer belt 125.

The fixing device 13 includes a heating roller 132 internally provided with an electrical heating element such as a halogen lamp as a heat source, and a pressure roller 134 arranged to face the heating roller 132. The fixing device 13 applies a fixing process to a toner image on a sheet P transferred in the image forming station 12 by giving heat from the heating roller 132 while the sheet P is passing through a fixing nip portion between the heating roller 132 and the pressure roller 134. The color-printed sheet P completed with the fixing process is discharged toward a sheet discharge tray 151 provided on the top of the apparatus main body 11 through a sheet discharge conveyance path 194 extending from an upper part of the fixing device 13.

The sheet feeding unit 14 includes a manual feed tray 141 openably and closably provided on a right side wall of the apparatus main body 11 in FIG. 1 and a sheet cassette 142 detachably mounted at a position below the exposure device 124 in the apparatus main body 11. The sheet cassette 142 stores a sheet stack P1 formed by stacking a plurality of sheets P. A pickup roller 143 is provided above the sheet cassette 142 and feeds the uppermost sheet P of the sheet stack P1 stored in the sheet cassette 142 toward a sheet conveyance path 190. The manual feed tray 141 is a tray provided at a lower position on the right surface of the lower main body 111 for manually feeding sheets P one by one toward the image forming station 12.

The vertically extending sheet conveyance path 190 is formed to the left of the image forming station 12. The pair of conveyor rollers 192 are provided at a suitable position in the sheet conveyance path 190 and convey a sheet P fed from the sheet feeding unit 14 toward a secondary transfer nip portion including the secondary transfer roller 196.

The sheet discharging unit 15 is formed between the lower and upper main bodies 111, 112. The sheet discharging unit 15 includes the sheet discharge tray 151 formed on the upper surface of the lower main body 111. The sheet discharge tray 151 is a tray onto which a sheet P having a toner image formed in the image forming station 12 is discharged after a fixing process is applied thereto in the fixing device 13.

The document reading unit 16 includes a contact glass 161 which is mounted in an upper surface opening of the upper main body 112 and on which a document is to be placed, a document pressing cover 162 which is free to open and close and presses a document placed on this contact glass 161 and a scanning mechanism 163 which scans and reads an image of a document placed on the contact glass 161. The scanning mechanism 163 optically reads an image of a document using an image sensor such as a CCD (Charge Coupled Device) or a CMOS (Complementary Metal Oxide Semiconductor) and generates image data. Further, the apparatus main body 11 includes an image processing unit (not shown) for generating an image from this image data.

<Configuration of the Developing Device>

Figure 2:
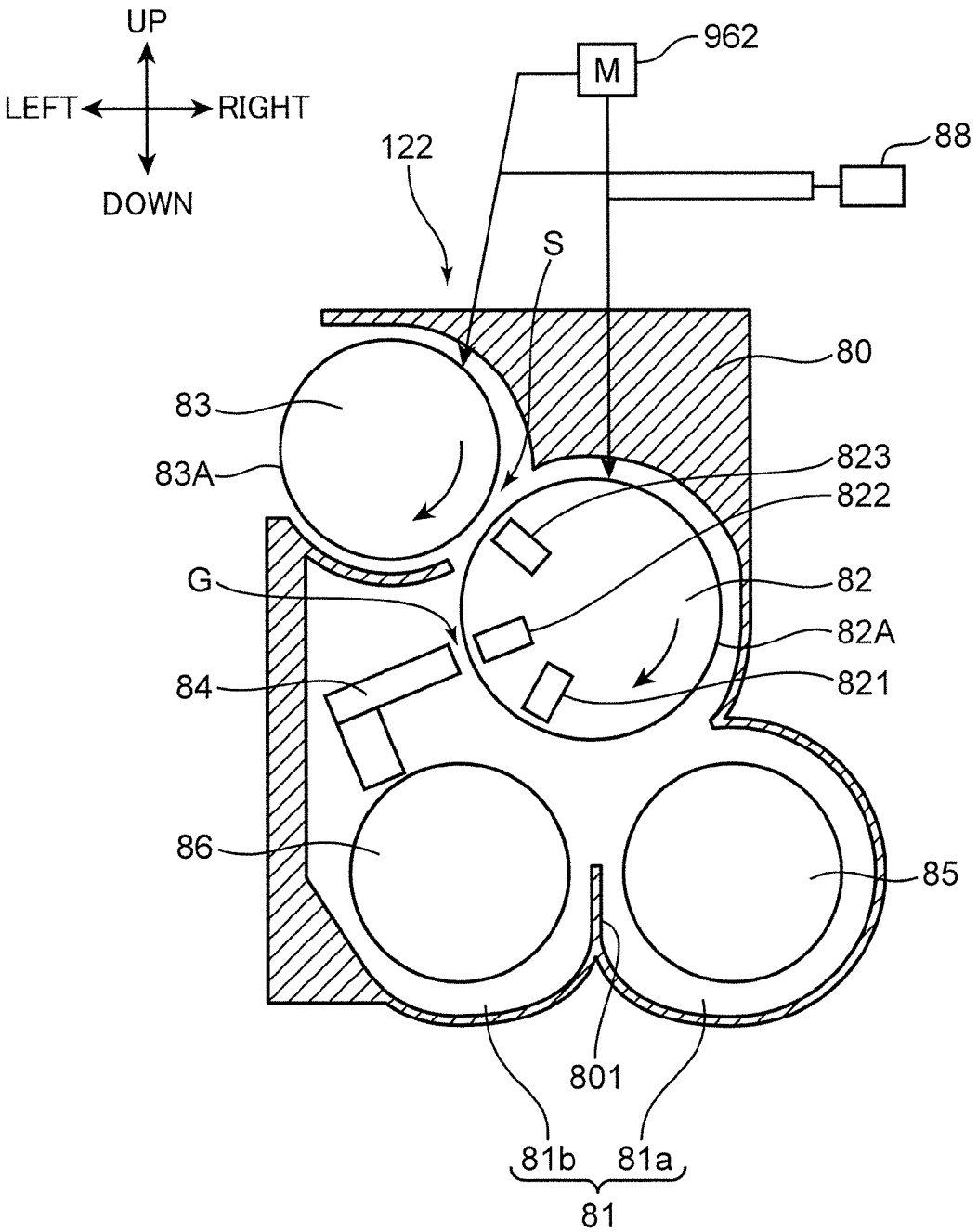
FIG. 2 is a sectional view of a developing device according to the embodiment of the present disclosure.
Figure 3A:
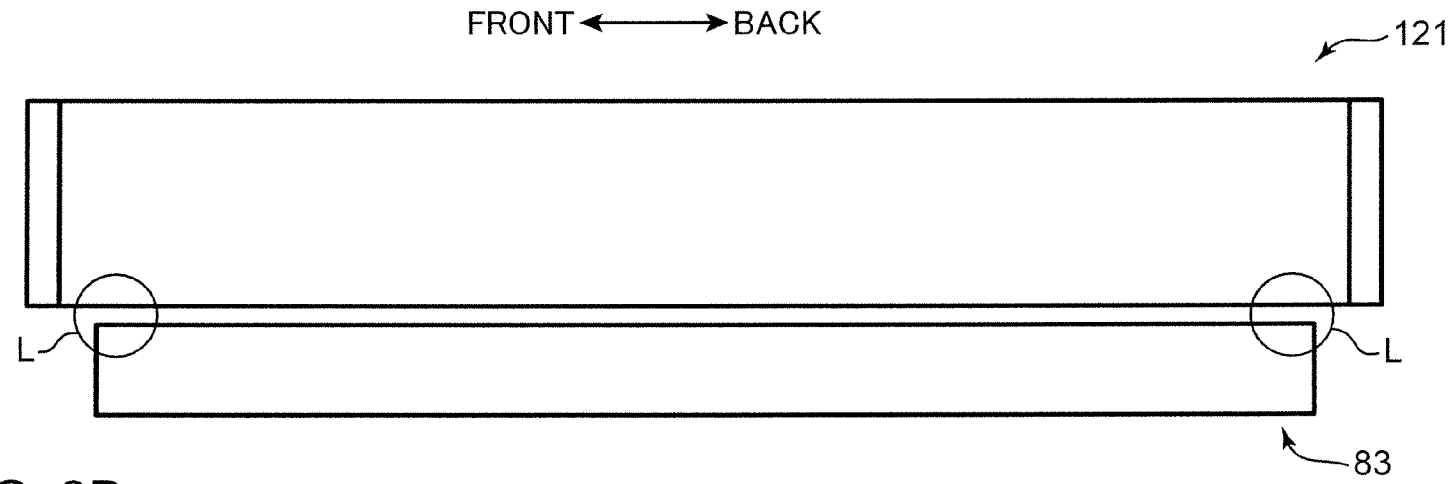
FIG. 3A is a diagram showing a relationship of axial lengths of a photoconductive drum and a developing roller according to the embodiment of the present disclosure.
Figure 3B:
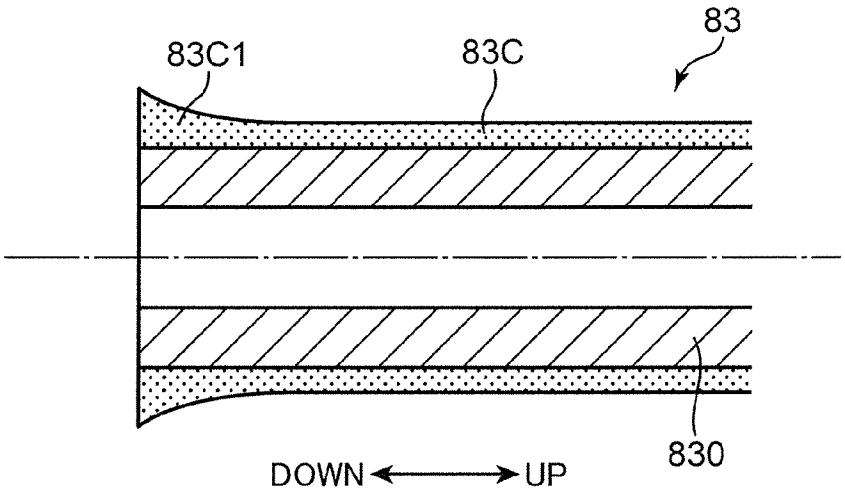
FIG. 3B is a schematic sectional view showing a film thickness on an end part of the developing roller according to the embodiment of the present disclosure.
Figure 4A:
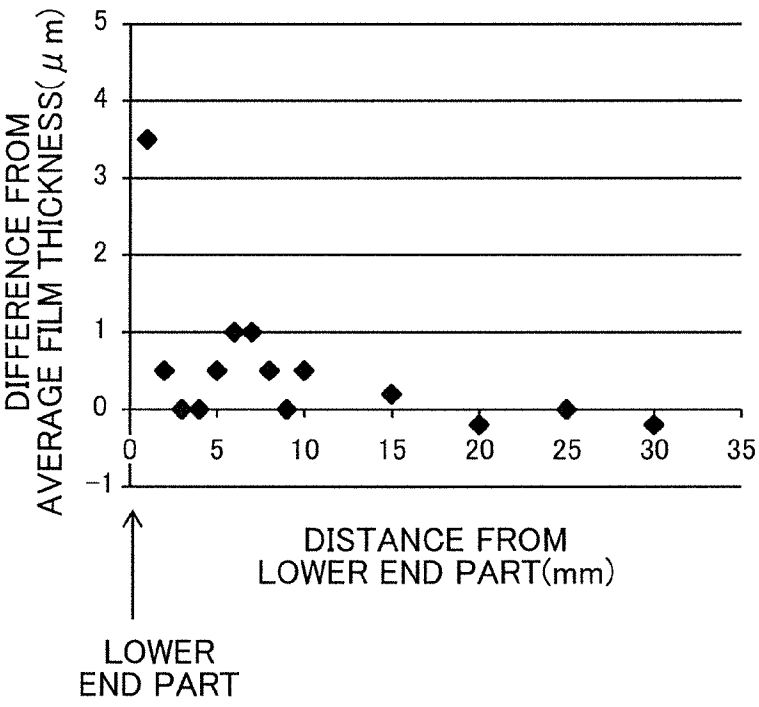
FIG. 4A is a graph showing an axial film thickness distribution of the developing roller according to the embodiment of the present disclosure.
Figure 4B:
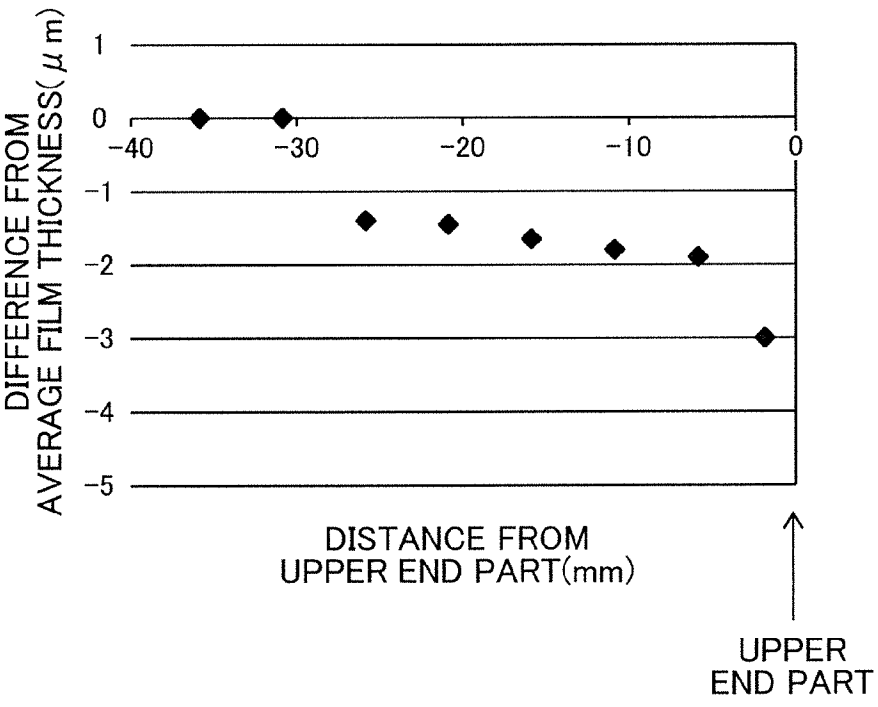
FIG. 4B is a graph showing an axial film thickness distribution of the developing roller according to the embodiment of the present disclosure.
Figure 5:
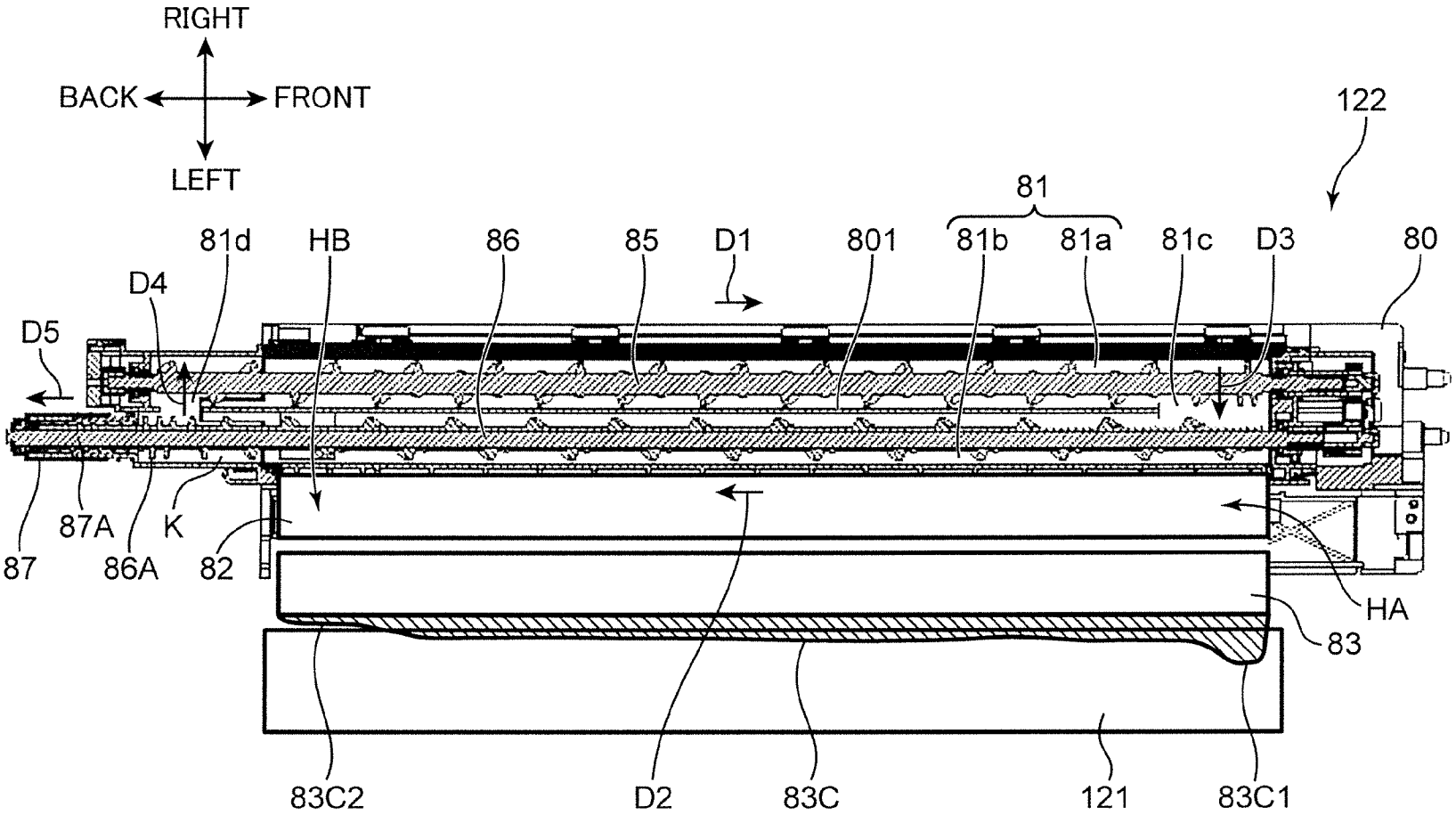
FIG. 5 is a schematic plan view of the developing device according to the embodiment of the present disclosure.

Next, the developing device 122 is described in detail. FIG. 2 is a vertical and lateral sectional view schematically showing the internal structure of the developing device 122. FIG. 3A is a diagram showing a relationship of axial lengths of the photoconductive drum 121 and a developing roller 83 according to this embodiment and FIG. 3B is a schematic sectional view showing a film thickness on an end part of the developing roller 83. FIGS. 4A and 4B are graphs showing axial film thickness distributions of the developing roller 83. FIG. 5 is a schematic plan view of the developing device 122 and the photoconductive drum 121 according to this embodiment. Note that a magnetic roller 82, the developing roller 83 and the photoconductive drum 121 are shown to be displaced to left in FIG. 5 for the sake of description. A touch-down development method using the developing roller 83 and the magnetic roller 82 is adopted for the developing device 122 in this embodiment. The developing device 122 includes a development housing 80 (housing) defining an internal space of the developing device 122. This development housing 80 includes a developer storage 81 (developer container) for storing a two-component developer containing nonmagnetic toner to be charged to a predetermined polarity and magnetic carrier. Further, the magnetic roller 82 (developer carrier) arranged above the developer storage 81, the developing roller 83 (toner carrier) arranged to face the magnetic roller 82 at a position obliquely above the magnetic roller 82 and a developer regulation blade 84 (layer thickness regulating member) arranged to face the magnetic roller 82 are arranged in the development housing 80. Further, the developing device 122 includes a driving unit 962 and a development bias applying unit 88 (FIG. 2).

With reference to FIGS. 2 and 5, the developer storage 81 includes two adjacent first developer storage chamber 81*a* and second developer storage chamber 81*b* extending in a longitudinal direction of the developing device 122. The second developer storage chamber 81*b* is arranged to face the magnetic roller 82. The first and second developer storage chambers 81*a*, 81*b* are partitioned from each other by a partition plate 801 integrally formed to the development housing 80 and extending in the longitudinal direction, but communicate with each other through first and second communication portions 81*c*, 81*d* at opposite end parts in the longitudinal direction (axial direction). A first screw feeder 85 and a second screw feeder 86 (conveying member) for agitating and conveying the developer by rotating about their axes are respectively housed in the first and second developer storage chambers 81*a*, 81*b*. The first and second screw feeders 85, 86 are each provided with a shaft and a screw blade arranged around the shaft. The first and second screw feeders 85, 86 are rotationally driven by the driving unit 962, but rotating directions and developer conveying directions thereof are set to be opposite to each other. This causes the developer to be conveyed in a circulating manner between the first and second developer storage chambers 81*a*, 81*b* while being agitated as indicated by arrows D1 (second conveying direction), D3, D2 (first conveying direction) and D4 of FIG. 5. By this agitation, the toner and the carrier are mixed and the toner is, for example, positively charged.

The magnetic roller 82 is rotatably supported in the development housing 80 to face the developing roller 83 along the longitudinal direction of the developing device 122. The magnetic roller 82 is driven to rotate in a clockwise direction in FIG. 2. A fixed so-called magnet roll (fixed magnet, not shown) is arranged in the magnetic roller 82. The magnet roll includes a plurality of poles; in this embodiment, a draw-up pole 821, a regulating pole 822 and a main pole 823. The draw-up pole 821 faces the developer storage 81, the regulating pole 822 faces the developer regulation blade 84 and the main pole 823 faces the developing roller 83.

The magnetic roller 82 magnetically draws up (receives) the developer onto a circumferential surface 82A thereof from the developer storage 81 by a magnetic force of the draw-up pole 821. The magnetic roller 82 magnetically carries the drawn-up developer as a developer layer (magnetic brush layer) on the circumferential surface 82A. Then, the magnetic roller 82 supplies the toner to the developing roller 83. With the rotation of the magnetic roller 82, the developer is conveyed toward the developer regulation blade 84.

The developer regulation blade 84 is arranged to face the magnetic roller 82 on a side upstream of a region, where the developing roller 83 and the magnetic roller 82 face each other, in a rotating direction of the magnetic roller 82. The developer regulation blade 84 regulates a layer thickness of the developer magnetically adhering to the circumferential surface 82A of the magnetic roller 82. A regulation gap G of a predetermined dimension is formed between the developer regulation blade 84 and the circumferential surface 82A of the magnetic roller 82. This causes a developer layer having a uniform predetermined thickness to be formed on the circumferential surface 82A.

The developing roller 83 is arranged to extend along the longitudinal direction of the developing device 122 and in parallel to the magnetic roller 82 and rotationally driven in a clockwise direction in FIG. 2. The developing roller 83 is arranged to face the photoconductive drum 121. The developing roller 83 is formed into a cylindrical shape and supported in the development housing 80 rotatably about an axis. The developing roller 83 has a circumferential surface 83A for carrying a toner layer by receiving the toner from the developer layer while rotating in contact with the developer layer held on the circumferential surface 82A of the magnetic roller 82. At the time of development in which a developing operation is performed, the developing roller 83 supplies the toner of the toner layer to the circumferential surface of the photoconductive drum 121. In this embodiment, the developing roller 83 is a roller with a cylindrical sleeve 830 (base member) and a resin coating (nylon coating) (surface layer) formed on a surface of the sleeve 830 (FIG. 3B).

The developing roller 83, the magnetic roller 82 and the first and second screw feeders 85, 86 are rotationally driven in synchronization by the driving unit 962. A clearance S of a predetermined dimension (FIG. 2) is formed between the circumferential surface 83A of the developing roller 83 and the circumferential surface 82A of the magnetic roller 82. The clearance S is, for example, set at 0.3 mm. The developing roller 83 is arranged to face the photoconductive drum 121 through an opening formed on the development housing 80 and a clearance of a predetermined dimension is also formed between the circumferential surface 83A and the circumferential surface of the photoconductive drum 121. In this embodiment, this clearance is set at 0.12 mm.

The development bias applying unit 88 applies development biases, in which an alternating-current voltage is superimposed on a direct-current voltage, to the magnetic roller 82 and the developing roller 83. A high alternating-current voltage is applied between the photoconductive drum 121 and the developing roller 83 and between the developing roller 83 and the magnetic roller 82. Particularly, since the toner is supplied from the magnetic roller 82 to the developing roller 83 and further supplied from the developing roller 83 to the photoconductive drum 121, a higher alternating-current voltage is applied to the developing roller 83 for the movement of the toner as compared with known one-component and two-component developing devices.

With reference to FIG. 5, the developing device 122 further includes a reverse conveying portion 86A (developer retaining portion) and a developer discharging portion 87. The reverse conveying portion 86A is a screw blade coaxially fixed to the second screw feeder 86 on a front end part of the second developer storage 81*b*, i.e. on a downstream side end part in a conveying direction (first conveying direction, arrow D2 of FIG. 5) of the second screw feeder 86. However, the screw blade of the reverse conveying portion 86A is arranged in a direction opposite to that of the screw blade of the second screw feeder 86 (reverse screw blade). The reverse conveying portion 86A is arranged to face a front end side of the second communication portion 81*d*. The reverse conveying portion 86A integrally rotates with the second screw feeder 86, pushes back the developer conveyed by the second screw feeder 86 in a reverse direction and causes the developer to be partially retained.

The developer discharging portion 87 communicates with the second developer storage 81*b* on a side before the reverse conveying portion 86A. The developer discharging portion 87 includes a hollow cylindrical wall portion internally including a space part and a discharge screw 87A configured to rotate in the space part. The discharge screw 87A is a screw blade coaxially fixed to the second screw feeder 86. The discharge screw 87A is arranged in the same direction as the screw blade of the second screw feeder 86. If part of the developer flows into the developer discharging portion 87 beyond the reverse conveying portion 86A from a developer retaining portion formed by the reverse conveying portion 86A, the developer is discharged from an unillustrated discharge port after being conveyed backward by the discharge screw 87A of the developer discharging portion 87 (arrow D5 of FIG. 5). As just described, a trickle technology for discharging part of the developer from the interior of the developing device 122 is adopted in this embodiment. Note that a toner density of the developer is reduced by the amount of the toner consumed by the developing roller 83 on a downstream side in the conveying direction of the second screw feeder 86. Thus, the developer having a high carrier ratio can be efficiently discharged from the developer discharging portion 87. Note that the carrier may be contained together with the toner in the toner cartridge (not shown) or another carrier supply tank may be provided to supply the carrier to the developing device 122.

With reference to FIG. 3A, the axial length of the photoconductive drum 121 is set longer than that of the developing roller 83 in this embodiment. Thus, opposite axial end parts of the developing roller 83 are facing the photoconductive drum 121 in regions L inwardly of opposite axial end parts of the photoconductive drum 121. Note that unillustrated tracking rollers are fixed to the opposite axial end parts of the developing roller 83. The tracking rollers regulate a gap between the developing roller 83 and the photoconductive drum 121 by being held in contact with the opposite end parts of the photoconductive drum 121. Further, the development housing 80 is biased toward the photoconductive drum 121 by an unillustrated biasing spring. As a result, the gap between the developing roller 83 and the photoconductive drum 121 is more stably maintained.

With reference to FIG. 3B, the sleeve 830 of the developing roller 83 is made of aluminum. A coating layer 83C of the developing roller 83 is formed by the following immersion method. First, an alumite processing is applied to the outer circumferential surface of the sleeve 830 to form an alumite layer (oxide layer) having a thickness of 10 μm. By forming the oxide layer on the sleeve 830 made of aluminum, an adhesive force of the coating layer 83C to the base member is increased. As a result, the peeling of the coating layer 83C is suppressed. Thereafter, the surface of the sleeve 830, i.e. the surface of the alumite layer is heated at 120° C. for 10 mins. This heating process is performed to intentionally crack the sleeve 830 in advance to suppress the formation of cracks in a drying step of the coating layer 83C. The time of the heating process is determined in advance, e.g. determined to be longer than a time required for the drying step. The heating process is constantly performed at a fixed temperature only for a fixed time. This causes a substantially fixed amount of cracks to be formed on all the sleeves 830 to which the heating process is applied.

A process of forming the coating layer 83C on the alumite layer is performed after the heating process. Specifically, a mixture liquid is prepared by mixing 100 weight parts of alcohol-soluble nylon resin as binder resin, pigments, 50 to 125 weight parts of titanium oxide as a conductive agent and 800 weight parts of methanol as a dispersion medium together with zirconia beads having a diameter of 1.0 mm in a ball mill for 48 hrs. The alumite-processed sleeve 830 having a diameter of 12 to 20 mm is pulled up after being immersed in that mixture liquid for a predetermined time, and dried for 10 mins. under a high-temperature environment of 130° C. Note that the sleeve 830 is so immersed into the mixture liquid that an axial direction of the cylindrical shape extends along a vertical direction, and then pulled up. Further, when the sleeve 830 is pulled up, the mixture liquid adhering to the surface is scraped off by a hollow cylindrical blade made of polytetrafluoroethylene. As a result, the sleeve 830 coated with the coating layer 83C having a thickness of 2 to 11 μm is manufactured. As just described, cracks are formed on the alumite layer by the heating process in advance before the coating layer 83C is coated. This prevents the conductive agent contained in the coating layer 83C from being unevenly distributed due to the influence of a convection generated in the coating layer 83C during the drying of the coating layer 83C. As a result, it is possible to form the coating layer 83C in which the conductive agent is evenly dispersed. Further, since only titanium oxide is dispersed as the conductive agent in the coating layer 83C, the coating layer 83C is formed to be harder and the abrasion of the coating layer 83C is reduced.

On the other hand, in the case of forming the coating layer 83C by the immersion method as described above, the mixture liquid adhering to the surface of the sleeve 830 tends to drip downward due to gravity when the sleeve 830 is pulled up. Thus, the coating layer 83C relatively thicker than in an axial central part is formed on the surface of a part of the sleeve 830 located on a lower end side at the time of immersion. Particularly, a pool part 83C1 where the thickness of the coating layer 83C is large tends to be formed on a lower end part of the sleeve 830. Further, the coating layer 83C (thin layer part 83C2) thinner than in the axial central part is formed on the surface of a part of the sleeve 830 located on an upper end side at the time of immersion.

FIG. 4A shows a film thickness distribution of the lower end side of the coating layer 83C formed on the sleeve 830. On the other hand, FIG. 4B shows a film thickness distribution of the upper end side of the coating layer 83C formed on the sleeve 830. In each of FIGS. 4A and 4B, a horizontal axis represents a distance from the end part of the sleeve 830 and a vertical axis represents a film thickness corresponding to each position in the axial direction as a difference from an average film thickness of the coating layer 83C. As shown in FIGS. 4A and 4B, a thin part of the coating layer 83C on the upper end part is longer than the thick part on the lower end part. Further, a maximum film thickness reduction (3 μm) on the upper end part of the coating layer 83C is a value approximate to a maximum film thickness increase (3.5 μm) on the lower end part.

In FIG. 5, the distribution of the coating layer 83C on the developing roller 83 is shown in an exaggerated manner. As described above, in this embodiment, the coating layer 83C is formed by the immersion method of immersing the sleeve 830 in a predetermined immersion tank such that the axial direction of the developing roller 83 extends along the vertical direction. The developing roller 83 is so mounted in the development housing 80 that the lower end side of the developing roller 83 at the time of immersion is arranged on an upstream side in the conveying direction of the second screw feeder 86 (arrow D2 of FIG. 5) and the upper end side of the developing roller 83 at the time of immersion is arranged on a downstream side in the conveying direction.

The second screw feeder 86 adjacent to the magnetic roller 82 supplies the developer to the magnetic roller 82 while conveying the developer in the conveying direction (first conveying direction) from one axial end side toward the other axial end side in the second developer storage 81*b*. At this time, a developer agitating time by the second screw feeder 86 becomes longer toward the downstream side in the first conveying direction. Thus, a charge amount of the developer on the upstream side in the first conveying direction tends to be lower than that of the developer on the downstream side. If the charge amount of the toner on the magnetic roller 82 on the upstream side in the first conveying direction is low, a charge amount of the toner on the developing roller 83 is also low. Since the responsiveness of the toner to a development electric field formed by a development bias is low if the charge amount of the toner is low, development performance is reduced. On the other hand, since the charge amount of the toner is relatively high on the downstream side in the first conveying direction, development performance is partially increased. As a result, an image density tends to vary along the first conveying direction. Even in such a case, in this embodiment, the lower end side of the sleeve 830 at the time of immersion is arranged in the upstream side of the development housing 80 in the first conveying direction and the upper end side of the sleeve 830 at the time of immersion is arranged in the downstream side of the development housing 80 in the first conveying direction. Thus, on the upstream side in the first conveying direction, the gap between the developing roller 83 and the photoconductive drum 121 becomes narrower and development performance is adjusted to be partially high. Thus, also on the upstream side in the first conveying direction where the charge amount of the toner is relatively low, the toner is stably supplied from the developing roller 83 to the photoconductive drum 121. On the other hand, on the downstream side in the first conveying direction, the gap between the developing roller 83 and the photoconductive drum 121 becomes wider and development performance is adjusted to be partially low. As a result, a variation of the image density in the axial direction of the developing roller 83 is suppressed even if the charge amount of the toner is distributed to be higher along the first conveying direction.

Further, in this embodiment, the developer is partly retained by the reverse conveying portion 86A (region K of FIG. 5) on the downstream side in the conveying direction of the second screw feeder 86 as described above. If the amount of the developer circulating in the developer storage 81 is increased, the retaining portion for the developer by the reverse conveying portion 86A may be extended to a region adjacent to a downstream end part of the magnetic roller 82 in the first conveying direction. In this case, the amount of the developer carried on the circumferential surface increases on the downstream end part of the magnetic roller 82 in the first conveying direction (region HB of FIG. 5). As a result, the amount of the developer on the underside (lower side) of the developer regulation blade 84 (FIG. 2) increases and the amount of the developer passing through the developer regulation blade 84 also increases. A large amount of the developer carried on the magnetic roller 82 is difficult to pass through the clearance S (FIG. 2) between the magnetic roller 82 and the developing roller 83, whereby the clogging of the toner tends to occur. Further, the developer retained between the magnetic roller 82 and the developing roller 83 has nowhere to go and tends to spill out of the development housing 80 after moving along the axial direction. In addition, the coating layer 83C on the developing roller 83 is polished by a magnetic brush formed by a large amount of the developer on the magnetic roller 82, thereby shortening a life of the coating layer 83C.

In this embodiment, the upper end side of the developing roller 83 at the time of immersion is arranged on the downstream side in the conveying direction of the second screw feeder 86. Specifically, with reference to FIG. 5, the thin layer part 83C2 of the coating layer 83C is arranged to face the downstream end part of the magnetic roller 82 in the first conveying direction. Thus, the clearance S between the magnetic roller 82 and the developing roller 83 becomes partly wider on the downstream side part of the magnetic roller 82 in the first conveying direction. As a result, a large amount of the developer carried on the circumferential surface of the magnetic roller 82 easily moves through between the magnetic roller 82 and the developing roller 83. Thus, the clogging of the developer in the clearance S and the spill-out of the developer from the development housing 80 are suppressed. Further, the polishing and thinning of the coating layer 83C by the magnetic brush on the magnetic roller 82 in the clearance S are suppressed.

On the other hand, the developer is transferred from the first developer storage 81*a* to the second developer storage 81*b* via the first communication portion 81*c* on the upstream side in the conveying direction of the second screw feeder 86. The transferred developer is conveyed in the direction of the arrow D2 of FIG. 5 by a conveying force of the second screw feeder 86. Thus, on the upstream end part of the second developer storage 81*b*, the developer is less likely to be pooled and the amount of the developer carried on the magnetic roller 82 becomes relatively smaller (region HA of FIG. 5). In this case, since the magnetic brush on the magnetic roller 82 is thinned, a scraping force of the magnetic brush is reduced. As a result, the old toner carried on the developing roller 83 is less likely to return toward the magnetic roller 82 and an image history tends to remain on the developing roller 83 (development ghost).

In this embodiment, the lower end side of the developing roller 83 at the time of immersion is arranged on the upstream side in the first conveying direction of the second screw feeder 86 to solve a problem occurring on the upstream side of the magnetic roller 82 in the first conveying direction as described above. Specifically, with reference to FIG. 5, the pool part 83C1 of the coating layer 83C is arranged to face the upstream end part of the magnetic roller 82 in the first conveying direction. Thus, on the upstream side part of the magnetic roller 82 in the first conveying direction, the coating layer 83C becomes partly thicker to narrow the gap between the magnetic roller 82 and the developing roller 83. Therefore, even if the amount of the developer carried on the magnetic roller 82 is relatively small, the scraping force of the toner by the magnetic brush is ensured and the old toner carried on the developing roller 83 is efficiently recovered toward the magnetic roller 82. As a result, the image history on the developing roller 83 is suppressed and the occurrence of development ghost on an image is suppressed. As described above, since the arrangement of the vertical end parts of the developing roller 83 at the time of immersion is properly set according to the conveying direction of the second screw feeder 86 in this embodiment, the toner is stably supplied from the upstream side to the downstream side in the conveying direction of the second screw feeder 86, i.e. from the developing roller 83 to the magnetic roller 82 in the entire axial direction.

Further, the developing device 122 includes the developer discharging portion 87 in this embodiment. A life of the developer is maintained long by gradually exchanging the developer, particularly the carrier, in the developer storage 81. As a result, stable images are formed over a long period of time. Even if the developer is retained by the reverse conveying portion 86A on the downstream end part of the second screw feeder 86, the clogging and spill-out of the developer, and further drastic thinning of the coating layer 83C are suppressed since the upper end side of the developing roller 83 at the time of immersion is arranged on the downstream side in the first conveying direction.

Although the developing device 122 and the image forming apparatus 1 according to the embodiment of the present disclosure are described above, the present disclosure is not limited to these. For example, the following modifications can be adopted.

(1) Although the above embodiment is described taking a full-color image forming apparatus as the image forming apparatus 1, the present disclosure is not limited to this. The image forming apparatus 1 may be a monochromatic image forming apparatus for printing a black-and-white image.

(2) In the above embodiment, the reverse conveying portion 86A (developer retaining portion) is described to partially retain the developer to discharge the developer from the developer discharging portion 87. The present disclosure is not limited to this. An unillustrated bearing portion for rotatably supporting the second screw feeder 86 may be mounted on the downstream end part of the second screw feeder 96 in the conveying direction in the development housing 80. The reverse conveying portion 86A may cause the developer to be partially retained to suppress the entrance of the developer into the above bearing portion.

Figure 6:
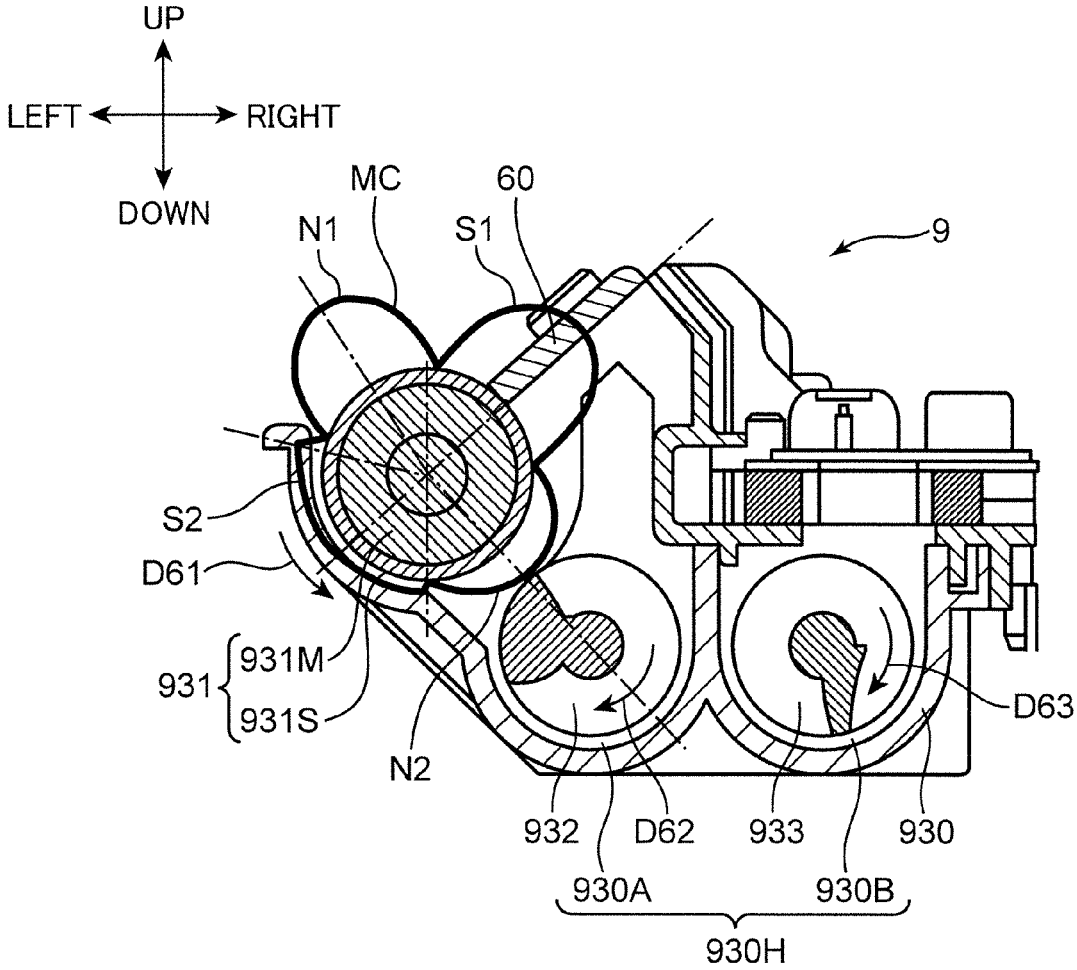
FIG. 6 is a sectional view of a developing device according to a modification of the present disclosure.
Figure 7:
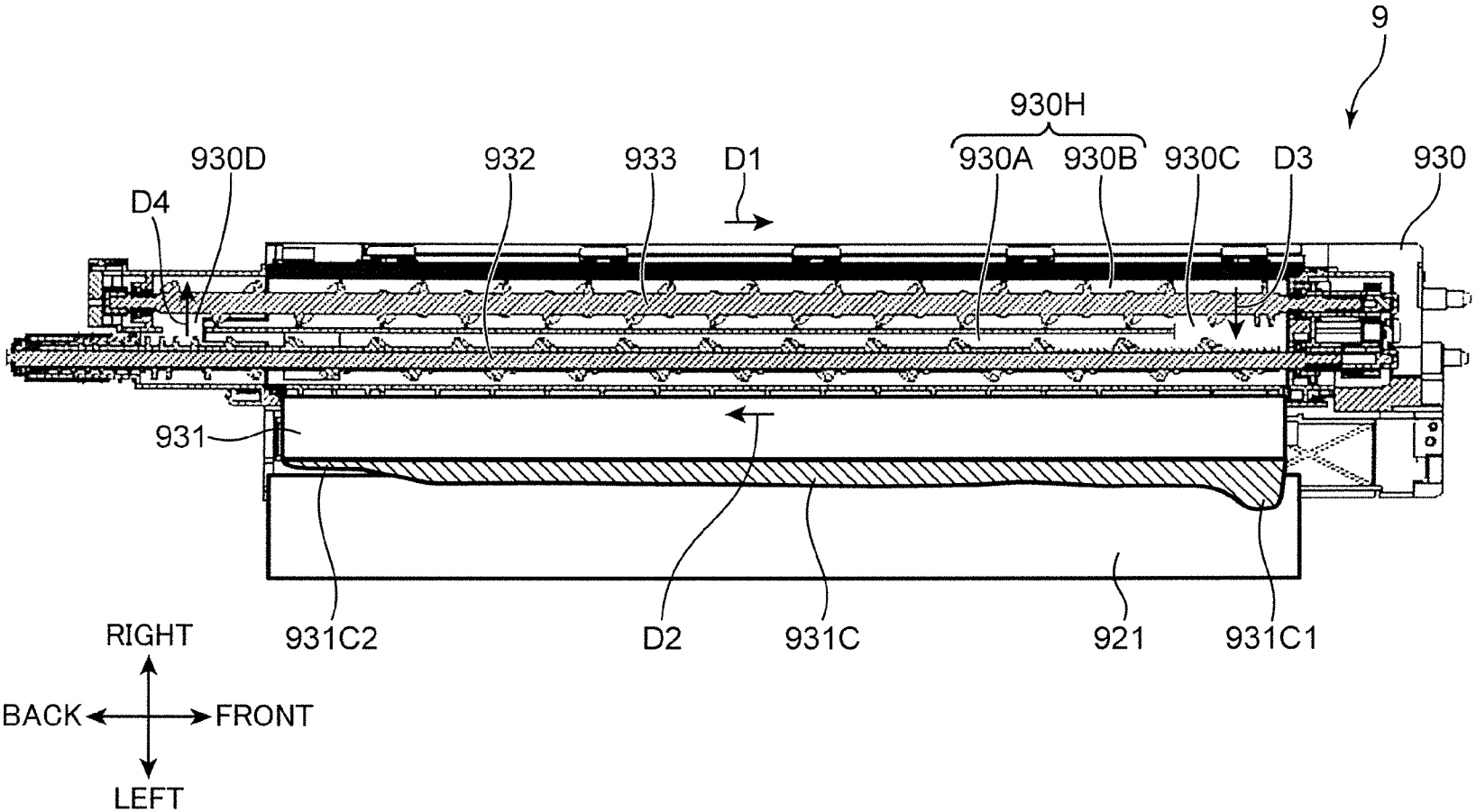
FIG. 7 is a schematic plan view of the developing device according to the modification of the present disclosure.
Figure 8:
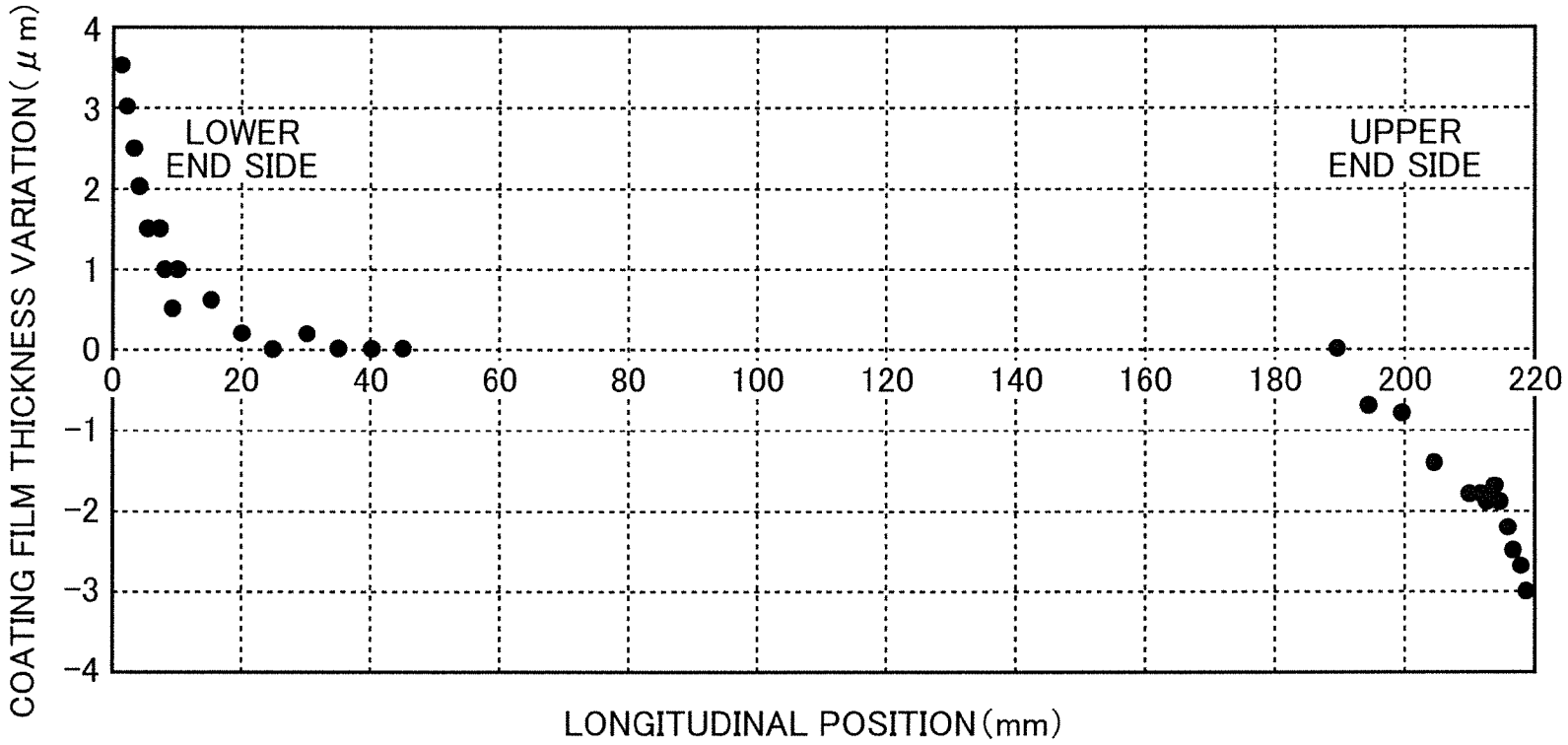
FIG. 8 is a graph showing a film thickness of a developing roller according to the modification of the present disclosure.

(3) Although the above embodiment is described using the developing device 122 adopting the touch-down development method, the present disclosure is not limited to this. FIG. 6 is a sectional view of a developing device 9 according to a modification of the present disclosure. FIG. 7 is a schematic plan view of the developing device 9. Note that a thickness of a coating layer 931C to be described later is shown in an exaggerated manner. FIG. 8 is a graph showing a film thickness of a developing roller 931 of the developing device 9.

The developing device 9 includes a development housing 930 (housing), the developing roller 931 (developer carrier), a first screw feeder 932 (conveying member), a second screw feeder 933 and a regulation blade 60 (layer thickness regulating member). A magnetic one-component development method is adopted for the developing device 9.

A developer storage 930H is provided in the development housing 930. A magnetic one-component developer is stored in the developer storage 930H. Further, the developer storage 930H includes a first conveying portion 930A in which the developer is conveyed in a first conveying direction (direction perpendicular to the plane of FIG. 6, direction from front to back, direction of an arrow D2 of FIG. 7) from one end side toward the other end side in an axial direction of the developing roller 931, and a second conveying portion 930B which communicates with the first conveying portion 930A at opposite axial end parts and in which the developer is conveyed in a second conveying direction (direction of an arrow D1 of FIG. 7) opposite to the first conveying direction. The first and second conveying portions 930A, 930B are allowed to communicate by a first communication port 930C and a second communication port 930D. First and second screw feeders 932, 933 are respectively rotated in directions of arrows D62, D63 of FIG. 6 and convey the developer in the first conveying direction (arrow D2 of FIG. 7) and the second conveying direction (arrow D1 of FIG. 7). Particularly, the first screw feeder 932 supplies the developer to the developing roller 931 while conveying the developer in the first conveying direction. The developer is conveyed between the first and second conveying portions 930A, 930B in a circulating manner while being agitated as shown by arrows D1, D3, D2 and D4 of FIG. 7.

The developing roller 931 is arranged at a distance from a photoconductive drum 921 (FIG. 7, image carrier) on a surface of which an electrostatic latent image is to be formed. The developing roller 931 includes a rotary sleeve 931S and a magnet 931M (fixed magnet) fixedly arranged in the sleeve 931S. In FIG. 6, a solid line MC indicates a magnetic force distribution in a normal direction to the magnet 931M. The magnet 931M includes poles S1, N1, S2 and N2. As just described, in this modification, the magnet 931M includes a plurality of magnetic poles adjacently arranged along a circumferential direction in the rotation of the sleeve 931S and the polarities of the plurality of magnetic poles are so set that different magnetic poles are alternately arranged along the circumferential direction.

Further, the developing roller 931 is rotated in a direction of an arrow D61 of FIG. 6. The regulation blade 60 is arranged at a predetermined distance from the developing roller 931 and regulates a layer thickness of the developer supplied onto the circumferential surface of the developing roller 931 from the first screw feeder 932. Further, magnetic toner (magnetic one-component developer) is frictionally charged (charged) between the regulation blade 60 and the developing roller 931.

In this modification, the sleeve 931S of the developing roller 931 corresponds to a base member of the present disclosure. A coating layer 931C (FIG. 7) is formed on a surface of the sleeve 931S. In other words, the base member is a part of the developing roller 931 and the coating layer is formed on the circumferential surface of the developing roller 931. The coating layer 931C is formed by an immersion method of immersing the sleeve 931S in a predetermined immersion tank so that an axial direction of the sleeve 931S extends along the vertical direction. Note that the coating layer 931C is formed in a step similar to that for the coating layer 83C according to the previous embodiment.

With reference to FIG. 8, the coating layer 931C is partly thinner at a position of 190 mm to 220 mm on the upper end side at the time of immersion in a longitudinal direction (axial direction) of the sleeve 931S (roller thin layer part 931C2, FIG. 7). On the other hand, the coating layer 931C is partly thicker at a position of 0 mm to 20 mm on the lower end side at the time of immersion in the longitudinal direction (axial direction) of the sleeve 931S (roller thick layer part 931C1, FIG. 7). In this modification, a lower end side (roller thick layer part 931C1 of the coating layer 931C) of the sleeve 931S at the time of immersion is arranged in an upstream side of the development housing 930 in the first conveying direction and an upper end side (roller thin layer part 931C2 of the coating layer 931C) of the sleeve 931S at the time of immersion is arranged in an downstream side of the development housing 930 in the first conveying direction.

The developing roller 931 receives the one-component developer from the first screw feeder 932 and supplies the developer to the photoconductive drum 921. In the first conveying portion 930A, a developer agitating time by the first screw feeder 932 becomes longer toward the downstream side in the first conveying direction. As a result, a charge amount of the developer on the developing roller 931 on the upstream side in the first conveying direction becomes relatively lower and an image density on the photoconductive drum 921 on the upstream side in the first conveying direction tends to be reduced. Further, in such a region where the charge amount is low, the developer easily scatters around and developer fogging easily occurs. A number of revolutions of the first screw feeder 932 of less than 100 rpm, particularly 10 to 60 rpm can be cited as a condition on which the charge amount of the developer easily varies along the first conveying direction in this way. In this modification, out of the coating layer 931C of the developing roller 931, a film thickness on the upstream side in the first conveying direction is set to be partly large (roller thick layer part 931C1, FIG. 7). Thus, on the upstream side in the first conveying direction, a gap between the developing roller 931 and the photoconductive drum 921 becomes narrower and development performance is increased. Therefore, the developer is stably supplied from the developing roller 931 to the photoconductive drum 921 also on the upstream side in the first conveying direction where the charge amount of the developer is relatively low. As a result, a variation of the image density along the first conveying direction is suppressed.

Further, in this modification, different magnetic poles are alternately arranged along the circumferential direction in the magnet 931M as described above. Thus, as compared with the case where a strong peeling magnetic pole is formed, the developer is less likely to be peeled from the sleeve 931S of the developing roller 931 and the developer tends to continue to turn around on the sleeve 931S while moving in the first conveying direction. Since such a developer passes through the regulation blade 60 a plurality of number of times as it moves toward the downstream side in the first conveying direction, the charge amount is increased by frictional charging. Thus, the image density tends to vary along the first conveying direction. Even in such a case, the lower end side of the sleeve 931S at the time of immersion is arranged in the upstream side of the housing in the first conveying direction and the upper end side of the sleeve 931S at the time of immersion is arranged in the downstream side of the housing in the first conveying direction. As a result, the gap between the developing roller 931 and the photoconductive drum 921 is partly adjusted to suppress a variation of the image density along the first conveying direction.

Note that, with reference to FIG. 6, fan-shaped magnetic members corresponding to the poles N1, S1 and N2 may be arranged in the magnet 931M and the pole S2 may be formed as a dummy pole by magnetizing three magnetic poles. Even in such a case, the developer may turn around on the sleeve 931 as described above since no strong peeling magnetic field is formed. Thus, "that magnetic poles having different polarities are alternately arranged in a circumferential direction" means the arrangement of the magnetic poles in the developing roller 931 after magnetization in the present disclosure.

EXAMPLES

Evaluation 1

Next, a preferred mode of the developing device 122 according to the previous embodiment is described by way of examples. Each of the following experiments were conducted under the following experimental conditions.

<Concerning Experimental Conditions>

Development method: two-component developer touch-down development method

Printing speed: 55 pages/min.

Photoconductive drum 121: a-Si photoconductor

Circumferential speed of the photoconductive drum 121: 275 mm/sec.

Developing roller 83: alumite surface processing+nylon resin coating

Circumferential speed of the developing roller 83: ratio of 1.6 (with rotation) to that of the photoconductive drum 121

Circumferential speed of the magnetic roller 82: ratio of 1.1 (counter rotation) to that of the developing roller 83

Gap between the photoconductive drum 121 and the developing roller 83: 0.1 mm Gap between the magnetic roller 82 and the developing roller 83: 0.25 mm Surface potential of the photoconductive drum 121: +230 V (background part), +20 V (image part)

Development bias applied to the developing roller 83: alternating-current voltage having a frequency of 4.7 kHz, duty ratio of 43%, Vpp of 1700 V, direct-current voltage of 50 V Development bias applied to the magnetic roller 82: alternating-current voltage having a frequency of 4.7 kHz, duty ratio of 68%, Vpp of 700 V, direct-current voltage of 280 V Average toner particle diameter: 6.8 μm (positive charge type)

In Example 1 (Table 1), the developing roller 83 was so mounted in the development housing 80 that the lower end side of the developing roller 83 at the time of immersion was arranged on the upstream side in the first conveying direction of the second screw feeder 86 and the upper end side of the developing roller 83 at the time of immersion was arranged on the downstream side in the first conveying direction. On the other hand, in Comparative Example 1 (Table 2), the developing roller 83 was so mounted in the development housing 80 that the upper end side of the developing roller 83 at the time of immersion was arranged on the upstream side in the first conveying direction of the second screw feeder 86 and the lower end side of the developing roller 83 at the time of immersion was arranged on the downstream side in the first conveying direction. In each of Example and Comparative Example, 500 K (500×1000) images having an image density of 3.8% were successively printed. A change of the film thickness of each coating layer and an image evaluation of leading end high density are shown in Tables 1 and 2. Note that the leading end high density is such an image defect that the image density is partly higher on a leading end of a sheet in a conveying direction in the case of printing a whole surface solid image (image density of 100%). Particularly, when toner recovery from the developing roller 83 to the magnetic roller 82 is poor on the upstream side of the magnetic roller 82 in the conveying direction of the second screw feeder 86, the amount of the toner carried on the developing roller 83 temporarily increases and the image density becomes higher. In Tables 1 and 2, ○ denotes a case where the leading end high density did not occur and x denotes a case where the leading end high density occurred.

TABLE 1

| | Example 1 | Start | 100 K | 200 K | 300 K | 400 K | 500 K |
|---|---|---|---|---|---|---|---|
| Film Thickness (μm) | Upstream Side | 10 | 8.9 | 7.9 | 7 | 6.1 | 5.3 |
| | Downstream Side | 4 | 3.8 | 3.6 | 3.5 | 3.3 | 3.2 |

TABLE 1-continued

| | Example 1 | Start | 100 K | 200 K | 300 K | 400 K | 500 K |
|---|---|---|---|---|---|---|---|
| Leading End High Density | | ○ | ○ | ○ | ○ | ○ | ○ |

TABLE 2

| | C. Example 1 | Start | 100 K | 200 K | 300 K | 400 K | 500 K |
|---|---|---|---|---|---|---|---|
| Film Thickness (μm) | Upstream Side | 4 | 3.9 | 3.8 | 3.6 | 3.5 | 3.5 |
| | Downstream Side | 10 | 8.5 | 6.9 | 5.3 | 3.9 | 2.6 |
| Leading End High Density | | x | x | x | x | x | x |

As shown in Table 1, the developer easily passed through between the developing roller 83 and the magnetic roller 82 by arranging the upper end side (having an initial film thickness of 4 μm) of the developing roller 83 at the time of immersion on the downstream side in the first conveying direction of the second screw feeder 86 in Example 1. Thus, the film thickness of the coating layer 83C was not below 3 μm when the printing of 500 K images was finished. Further, throughout the experiment, the leading end high density did not occur and stable images were maintained. On the other hand, in Comparative Example 1, the coating layer 83C was thinned by arranging the lower end side (having an initial film thickness of 10 μm) of the developing roller 83 at the time of immersion on the downstream side in the first conveying direction of the second screw feeder 86 and the film thickness of the coating layer 83C was below 3 μm when the printing of 500 K images was finished. Furthermore, toner recovery from the developing roller 83 was poor from the initial stage to the end of the experiment, resulting in the occurrence of the leading end high density.

Evaluation 2

Next, a preferred mode of the developing device 9 is described by way of examples. Each of the following experiments was conducted under the following experimental conditions.

<Concerning Experimental Conditions>

Development method: magnetic one-component development method (magnetic toner)

Printing speed: 25 pages/min.

Photoconductive drum 921: OPC photoconductor

Circumferential speed of the photoconductive drum 921: 170 mm/sec.

Number of revolutions of the first screw feeder 932: 57 rpm

Developing roller 931: alumite surface processing+nylon resin coating

Circumferential speed of the developing roller 931: ratio of 1.4 (with rotation) to that of the photoconductive drum 921

Gap between the photoconductive drum 921 and the developing roller 931: 0.25 mm Developer conveying amount on the developing roller 931: 0.71 mg/cm$^2$ Surface potential of the photoconductive drum 921: +430 V (background part), +100 V (image part)

Development bias applied to the developing roller 931: alternating-current voltage having a frequency of 4.7 kHz, duty ratio of 43%, Vpp of 1700 V, direct-current voltage of 150 V Average toner particle diameter: 6.8 μm (positive charge type)

In Example 2, the coating layer 931C was formed on the sleeve 931S of the developing roller 931 by the immersion method (dipping method) as shown in the previous modification. The thickness of the coating layer 931C was set at 8 μm in a longitudinal (axial) central part. The upper end side of the developing roller 931 at the time of immersion was arranged on the downstream side in the first conveying direction of the first screw feeder 932 and the lower end side of the developing roller 931 at the time of immersion was arranged on the upstream side in the first conveying direction. On the other hand, in Comparative Example 2, the coating layer 931C was not formed on the sleeve 931C of the developing roller 931, i.e. a non-coated sleeve was used. In both Example 2 and Comparative Example 2, 3000 images having an image density of 0.2% were printed in a single intermittent mode. Each evaluation result after printing is shown in Table 3.

TABLE 3

| | Non-coating (C. Example 2) | | Dipping coating (Example 2) | |
|---|---|---|---|---|
| | Upstream side in conveying direction | Downstream side in conveying direction | Upstream side in conveying direction | Downstream side in conveying direction |
| Toner charge amount | 6 | 8 | 6 | 8 |
| I.D. (density) | 1.22 | 1.33 | 1.25 | 1.28 |
| Toner fogging | x | ○ | ○ | ○ |

In Table 3, a Model 210HS-2Aq/m Meter produced by Trek was used to measure the toner charge amount. Further, a Densit Meter TC-6DS produced by Tokyo Denshoku Co., Ltd. was used to measure the image density (I.D.) after printing. Further, in the evaluation of toner fogging, ○ denotes a level having no visual problem and x denotes a level in which fogging was visually confirmed.

In both Example 2 and Comparative Example 2, the toner charge amount on the downstream side in the first conveying direction of the first conveying portion 930A (FIG. 6) (8 μc/g) is higher than the toner charge amount on the upstream side in the first conveying direction (6 μc/g). In Comparative Example 2, a result was obtained in which a large difference was created also in the image density according to the toner charge amount. Further, on the upstream side in the first conveying direction, the toner having a low charge amount scattered toward the photoconductive drum 921 and toner fogging occurred.

On the other hand, in Example 2, a result was obtained in which development performance was adjusted by compensating for a difference in the toner charge amount by the gap between the photoconductive drum 921 and the developing roller 931 and a difference in the image density was reduced. Further, on the upstream side in the first conveying direction, the roller thick layer part 931C1 (FIG. 7) of the coating layer 931C was arranged at a position near the circumferential surface of the photoconductive drum 921 and the scattered toner and the unnecessary toner adhering to the circumferential surface of the photoconductive drum 921 were recovered, which resulted in the suppression of toner fogging.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device, comprising:

a housing;

a developer carrier formed into a cylindrical shape, supported in the housing rotatably about an axis and configured to carry a developer on a circumferential surface;

a developer container arranged in the housing to face the developer carrier and including a first conveying portion in which the developer is conveyed in a first conveying direction from one end side toward the other end side in an axial direction of the developer carrier, and a second conveying portion which communicates with the first conveying portion at opposite end parts in the axial direction and in which the developer is conveyed in a second conveying direction opposite to the first conveying direction;

a conveying member rotatably arranged in the first conveying portion and configured to convey the developer in the first conveying direction and supply the developer to the developer carrier; and a surface layer arranged on or arranged to face the circumferential surface of the developer carrier and formed on a surface of a predetermined cylindrical base member;

wherein:

the surface layer is formed by an immersion method of immersing the base member in a predetermined immersion tank so that an axial direction of the base member extends along a vertical direction; and a lower end side of the base member at the time of the immersion is arranged in an upstream side of the housing in the first conveying direction and an upper end side of the base member at the time of the immersion is arranged in a downstream side of the housing in the first conveying direction.

2. A developing device according to claim 1, wherein:

the developer contains toner and carrier;

the developing device further comprises:

a toner carrier formed into a cylindrical shape, arranged at distances from an image carrier, on a surface of which an electrostatic latent image is to be formed, and the developer carrier, supported in the housing rotatably about an axis and configured to receive the toner on a circumferential surface thereof from the developer carrier and carry the toner; and a layer thickness regulating member arranged at a predetermined distance from the developer carrier and configured to regulate a layer thickness of the developer supplied onto the circumferential surface of the developer carrier from the conveying member;

the base member is a part of the toner carrier; and the surface layer is formed on the circumferential surface of the toner carrier and arranged to face the circumferential surface of the developer carrier.

3. A developing device according to claim 1, wherein:

the base member is a part of the developer carrier;

the surface layer is formed on the circumferential surface of the developer carrier;

the developer carrier is arranged at a distance from an image carrier, on a surface of which an electrostatic latent image is to be formed;

the developer is a magnetic one-component developer; and the developing device further comprises a layer thickness regulating member arranged at a predetermined distance from the developer carrier and configured to regulate a layer thickness of the developer supplied onto the circumferential surface of the developer carrier from the conveying member.

4. A developing device according to claim 3, wherein:

the developer carrier includes:

a rotary sleeve formed of the base member; and a fixed magnet fixed in the sleeve;

the fixed magnet includes a plurality of magnetic poles adjacently arranged along a circumferential direction in the rotation of the sleeve; and the polarities of the plurality of magnetic poles are so set that different polarities are alternately arranged along the circumferential direction.

5. A developing device according to claim 2, further comprising:

a developer retaining portion arranged in a downstream end part of the first conveying portion in the first conveying direction and configured to partially retain the developer.

6. A developing device according to claim 5, further comprising:

a developer discharging portion configured to discharge part of the developer retained by the developer retaining portion from the housing.

7. A developing device according to claim 5, wherein:

the conveying member includes a shaft and a screw blade arranged around the shaft; and the developer retaining portion is a reverse screw blade arranged in a direction opposite to that of the screw blade on a downstream end part of the shaft in the conveying direction.

8. A developing device according to claim 1, wherein:

the surface layer is made of alcohol-soluble nylon in which only titanium oxide is dispersed.

9. A developing device according to claim 1, wherein:

the base member is made of aluminum and includes an oxide layer formed on the surface; and the surface layer is formed on a surface of the oxide layer.

10. An image forming apparatus, comprising:

a developing device according to claim 1; and an image carrier on a surface of which an electrostatic latent image is to be formed and to which the developer is supplied from the developing device.

* * * * *